United States Patent [19]

Duncan

[11] 4,318,690

[45] Mar. 9, 1982

[54] VENTING PROCESS FOR ORGANIC HEAT TRANSFER MEDIA

[75] Inventor: William J. Duncan, Chattanooga, Tenn.

[73] Assignee: E. I. Du Pont de Nemours and Company, Wilmington, Del.

[21] Appl. No.: 197,753

[22] Filed: Oct. 16, 1980

[51] Int. Cl.[3] ..... F27D 19/00; F27D 23/02

[52] U.S. Cl. ..... 432/41; 34/26; 432/2

[58] Field of Search ..... 432/1, 2, 26, 41, 34; 34/26, 34, 40; 165/104 M, 104.11

[56] References Cited

U.S. PATENT DOCUMENTS 3,942,262 3/1976 Perry ..... 34/40

4,253,821 3/1981 Bradshaw ..... 432/2

OTHER PUBLICATIONS

"Dowtherm A and E Handbook", The Dow Chemical Co., ©1960, 1963, pp. 1-9 and 48-52.

"Dowtherm Heat Transfer Fluids . . .", The Dow Chemical Co., ©1967, 1969, 1971, pp. 2-5 and 56-60.

*Primary Examiner*—John J. Camby

[57] ABSTRACT

A process for automatically venting noncondensable contaminants from a number of process vessels heated with an organic heat transfer vapor medium involves monitoring the temperature at each vessel and intermittently venting all vessels simultaneously in response to a temperature drop at any one vessel. By venting intermittently for a predetermined period energy is conserved. Equipment costs are minimized by simultaneous venting through a single control valve.

8 Claims, 1 Drawing Figure

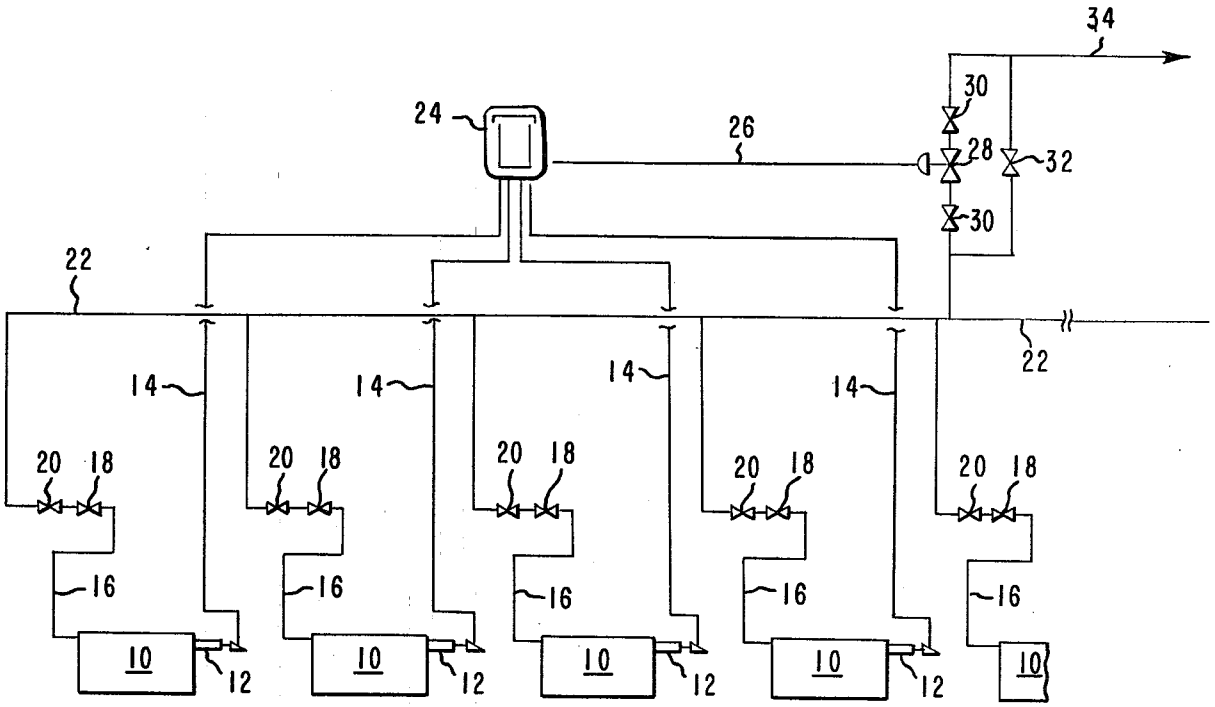
34
32
30
28
30
26
24
22
14
18
20
16
10
12

VENTING PROCESS FOR ORGANIC HEAT TRANSFER MEDIA

DESCRIPTION

1. Technical Field

This invention relates to an improved process for venting noncondensable impurities from organic heat transfer vapor being used to heat a plurality of process vessels from a common vapor source. More particularly, the invention relates to a process for automatically venting noncondensables from a number of such vessels simultaneously through a common vent.

2. Background Art

Heat transfer systems which employ condensable organic vapors are widely used for heating in the chemical process industry, especially to maintain higher temperatures than are practical or possible with the use of steam. In these condensing vapor phase heating systems the heat is transferred at the saturation temperature of the vapor as determined by the pressure in the system. This method of heat transfer provides a very uniform and constant temperature source.

A heat transfer medium widely used in such vapor heating systems is a eutectic mixture containing 26.5% diphenyl and 73.5% diphenyl oxide by weight. Such a mixture is sold by the Dow Chemical Company, Midland, Mich. as "Dowtherm" A heat transfer medium. "Dowtherm" is Dow's registered trademark for its heat transfer media.

Since the vapor of this organic medium is heavier than air, means must be provided in systems using it for removing air or other light noncondensing vapors from high points in the system to prevent portions of the system from becoming air bound with consequent improper heating. Therefore vent valves are usually placed at all high points in the system, such as at the tops of heated vessels, to allow venting of trapped air or other light impurities.

Upon prolonged operation, noncondensable decomposition products can form in the system and accumulate at high points so as to interfere with heating and result there in subnormal temperatures. Such problems are presently avoided by continuous or by periodic manual venting of vapors from critical locations throughout the vapor heating system.

For processes where the temperature must be maintained within close tolerances such as in the melt spinning of synthetic filaments, continuous venting at a rate sufficient to avoid problems is commonly practiced. Energy wasted by any excessive venting in the past has been considered an acceptable alternative to less reliable temperature control. The use of automatic intermittent systems has been discouraged. It has been suggested in the trade that all venting be done manually. It has also been acknowledged that a completely suitable thermostatic vent valve has not yet been developed.

In critical processes where continuous venting is practiced, the use of a reliable automatic vent control system at each venting position is precluded by the expense of a reliable system and the number of positions at which venting must take place.

An object of this invention is a reliable, economical, more energy-efficient venting process for vapor heat transfer systems having a large number of positions being heated to the same temperature (that is operating at the same vapor pressure) where precise control of temperature is required.

BRIEF DESCRIPTION OF THE DRAWING

The FIGURE is a schematic representation of a vent control system useful for the process of the invention showing a series of spinning blocks for manufacturing synthetic filaments with each block being equipped with a thermocouple and a vent in its top. The thermocouples are connected to a temperature sensing device which automatically activates a vent valve which vents vapor by means of connecting vent lines to each position from all of the spinning blocks simultaneously.

DISCLOSURE OF THE INVENTION

This invention provides an improved process for periodically removing noncondensible impurities from a closed pressurized heat transfer system of the type which employs a condensible organic vapor to heat a plurality of process vessels to substantially the same operating temperature by venting from said system a portion of said vapor along with noncondensable impurities from the top of each heated vessel whereby the operating temperatures of the vessels are maintained within prescribed limits wherein the improvement comprises monitoring the operating temperature at the top of each vessel and intermittently venting a portion of said vapor from all vessles simultaneously through a single automatically regulated valve in response to a predetermined decrease in the monitored operating temperature at any one of said vessels.

The length of time for which the vapor is vented in response to the decrease in temperature is limited according to the needs of the particular vessels involved. The length of time can be controlled by a timer set for a predetermined length of time as described herein or by a return of the monitored decreased temperature to normal. The former method can conserve slightly more vapor because of a time lag factor in the latter method.

In further description of the FIGURE, a series of identical melt-spinning blocks 10 are shown. The blocks are heated in a conventional manner by an organic heat transfer vapor (not shown). Connected to the top of each block 10 are a thermocouple temperature sensor 12 and a vapor vent line 16. Thermocouples 12 for each block 10 are connected by leads 14 to a temperature monitoring and control device 24, such as a temperature recorder with an alarm switch. Air operated valve 28 is operated automatically upon a signal through lead 26 from temperature monitoring device 24. Vent line 16 contains an optional blocking valve 18 followed by a throttling valve 20. Blocking valve 18 normally remains in open position and the flow of vapor through line 16 is regulated by throttling valve 20. When air operated valve 28 is opened vapor collectively flows through header 22 from lines 16 from each of blocks 10 into vent manifold 34 which conducts the vented vapor to a condenser (not shown) where condensable vapors are returned to the heat transfer system in a conventional manner and noncondensable vapor is released to the atmosphere. Associated with air operated valve 28 for maintenance reasons are blocking valves 30 and manual by-pass valve 32. Under normal operating conditions valves 30 remain open and valve 32 remains closed.

Conventional commercially available equipment can be used for the temperature sensing and vapor venting components of the control system. It is preferred that the throttling valves consist of "V" port valves for more effective control as a variable orifice to equalize the vapor flow from each vessel.

The location of the temperature sensing device (e.g. thermocouple) in each vessel is important. To permit adequate temperature control it should be located in the top of each vessel, preferably at a point where it is in free contact with the vapor. Where continuous venting has been employed it has been a common practice to position the temperature sensor in the vent line at some distance from the vessel itself. At such a location, the sensor is not sufficiently in contact with vapor in the vessel to be satisfactory for this invention.

The specific location of the temperature sensor in the top of the vessel and the temperature drop which can be allowed to occur before venting is initiated will depend upon the design of the vessel and can be readily determined by one skilled in the art. For instance, in some cases, a temperature of several degrees in the top of the vessel may be found to be allowable before having any effect on the process temperature itself. Accordingly, the venting can be programmed to recognize an acceptable drop before venting will occur as explained in the following example.

An adjustable timer can be used once venting is initiated to hold the automatic valve open for the desired time to accomplish adequate venting. The desired time period can be determined in practice by observing the frequency of venting and increasing the vent period until a longer period does not further decrease the frequency of venting, whereas a shorter period results in more frequent venting.

This invention is particularly suitable for vapor heating systems operated within the range of about 250° to 350° C. which range is commonly encountered in the polymerization and spinning of synthetic polyamides and polyesters commonly used for the manufacture of synthetic fibers and filaments.

Whereas the vent control system of this invention can be used for a single vessel, it is most advantageous and effective when used with at least four vessels, preferably eight, and even as many as sixteen or more.

EXAMPLE

An automatic venting process of the invention is tested on eight positions of a 32-position machine for melt spinning filaments of poly(hexamethylene adipamide). The machine has previously been operated with continuous venting through a throttling valve at each position.

An automatic vent control system of the type shown in the FIGURE is used with a thermocouple installed horizontally in the top of the spinning block in each of the eight positions. A "V" port valve is used as a throttling valve in the vent line from each of the eight blocks. A Leeds & Northrup Speedomax G recorder is used to monitor the temperatures from all the blocks. The blocks are heated to a temperature of 293° C. with "Dowtherm" A. Because of the design of the spinning blocks and the location of the polymer chambers within the block, it is found that a drop in temperature of more than 2°-3° C. normally is required before the polymer temperature will drop by 1° C. Consequently, the system is set to activate the air operated valve (Fisher Governor Co. Type 667A) upon sensing a drop of 2°-3° C. at any one of the eight spinning blocks. An alarm switch in the recorder is used to activate automatically an electrical solenoid valve which regulates a compressed air supply to operate the air operated valve which vents the vapors. An adjustable timer is used to keep the air operated valve open for a preset period of time. A valve opening period of about 20 seconds is found to be optimum for the installation. A shorter time of 10-11 seconds causes the system to vent more frequently. A longer time of about 90 seconds does not decrease the frequency of venting and therefore is a needless waste of energy.

The system functions satisfactorily for the duration of a four week test. Venting frequency varies from about 20 minutes between ventings to about five hours. The average frequency of venting periods is one every two hours.

Vent rate is determined by condensing, collecting and measuring the condensate over a fixed period of time for the continuous venting method and for the automatic intermittent venting method of the invention. The average vent rate per spinning block for continuous venting is found to be 12.3 lbs/hr (5.6 kg/hr) of condensate. With the automatic multiposition venting system of the invention the vent rate is found to be 0.7 lbs/hr/position (0.3 kg/hr) which constitutes a 94% reduction in vent rate. This reduction in vent rate results in considerable energy savings by not having to needlessly re-vaporize condensate.

What is claimed is:

1. An improved process for periodically removing noncondensable impurities from a closed pressurized heat transfer system of the type which employs a condensable organic vapor to heat a plurality of process vessels to substantially the same temperature by venting from said system a portion of said vapor along with contained noncondensable impurities from the top of each heated vessel whereby each vessel's operating temperature is maintained within prescribed limits wherein the improvement comprises monitoring the operating temperature at the top of each vessel and intermittently venting vapor from all vessels simultaneously through a valve regulated automatically in response to a predetermined decrease in the monitored operating temperature at any one of said vessels.

2. A process of claim 1 wherein the condensable organic vapor is a eutectic mixture of diphenyl and diphenyl oxide.

3. A process of claim 2 wherein said plurality of vessels consist of at least four substantially identical vessels being heated to the same temperature by a common source of vapor.

4. A process of claim 3 wherein said vessels are polymer transfer lines or spinning blocks for the manufacture of synthetic filaments and said plurality is at least eight.

5. A process of claim 4 wherein the vessels are spinning blocks maintained at a temperature within the range of from about 250° to 350° C.

6. A process of claim 5 wherein the venting period is for a time predetermined to minimize the venting frequency.

7. A process of claim 6 wherein each venting period is from 10 to 60 seconds.

8. A process of claim 3 wherein each venting period lasts only until the decreased temperature is restored to normal.

* * * * *